US011105518B2

(12) United States Patent
Shaffer

(10) Patent No.: US 11,105,518 B2
(45) Date of Patent: Aug. 31, 2021

(54) WALL SLEEVE ASSEMBLY FOR A PACKAGED TERMINAL AIR CONDITIONER UNIT

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 140 days.

(21) Appl. No.: 16/438,661

(22) Filed: Jun. 12, 2019

(65) Prior Publication Data

US 2020/0393142 A1 Dec. 17, 2020

(51) Int. Cl.

| | |
|---|---|
| ***F24F 1/027*** | (2019.01) |
| ***F24F 11/89*** | (2018.01) |
| ***F24F 13/32*** | (2006.01) |
| *F24F 13/20* | (2006.01) |

(52) U.S. Cl.

CPC ..... *F24F 1/027* (2013.01); *F24F 11/89* (2018.01); *F24F 13/32* (2013.01); *F24F 2013/205* (2013.01)

(58) Field of Classification Search

CPC ..... F24F 1/027; F24F 11/0001; F24F 11/89; F24F 13/32; F24F 2013/205

See application file for complete search history.

(56) References Cited

U.S. PATENT DOCUMENTS

| | | | | | |
|---|---|---|---|---|---|
| RE22,584 | E * | 12/1944 | Terry et al. | F24F 1/027 | 62/97 |
| 2,801,582 | A * | 8/1957 | Kuhlenschmidt | F24F 1/02 | 454/202 |
| 4,586,349 | A * | 5/1986 | Ohishi | F24F 13/24 | 454/201 |
| 5,370,576 | A * | 12/1994 | Krofchalk | B60H 1/00464 | 454/143 |
| 5,467,180 | A * | 11/1995 | Malachowski | B65H 29/242 | 271/197 |
| 6,196,013 | B1 * | 3/2001 | Kim | F24F 1/027 | 62/262 |
| 6,330,807 | B1 * | 12/2001 | Correa | F24F 1/027 | 62/262 |
| 7,802,443 | B2 | 9/2010 | Wetzel | | |
| 8,582,292 | B1 * | 11/2013 | Eichelberg | H05K 7/20718 | 361/679.49 |
| 9,327,047 | B1 * | 5/2016 | Lichtblau | A61L 9/20 | |

(Continued)

FOREIGN PATENT DOCUMENTS

| | | | |
|---|---|---|---|
| CN | 100513897 | C | 7/2009 |
| EP | 1484558 | A1 | 12/2004 |

*Primary Examiner* — Emmanuel E Duke

(74) *Attorney, Agent, or Firm* — Dority & Manning, P.A.

(57) ABSTRACT

A packaged terminal air conditioner unit includes a bulkhead and a sealed system mounted at least partially within a wall sleeve. The wall sleeve is positioned in an opening on the side of a building and defines an intake aperture and an exhaust aperture that fluidly couple the outdoor portion to the room. An intake fan assembly is mounted to the wall sleeve over the intake aperture for selectively urging a flow of make-up air into the room and an exhaust fan assembly if mounted to the wall sleeve over the exhaust aperture for selectively urging a flow of exhaust air out of the room.

20 Claims, 6 Drawing Sheets

(56) References Cited

U.S. PATENT DOCUMENTS

| | | | | |
|---|---|---|---|---|
| 2002/0056282 | A1* | 5/2002 | An | F24F 13/20 62/262 |
| 2004/0190270 | A1* | 9/2004 | Aldag | H05K 7/20572 361/752 |
| 2006/0005559 | A1* | 1/2006 | Lim | F24F 13/20 62/262 |
| 2007/0295208 | A1* | 12/2007 | Fairchild | B03C 3/455 95/74 |
| 2008/0156891 | A1* | 7/2008 | Zhou | F24F 3/1405 236/44 C |
| 2017/0198934 | A1* | 7/2017 | Shaffer | F24F 13/14 |
| 2019/0024910 | A1* | 1/2019 | Jung | F24F 1/027 |

* cited by examiner

WALL SLEEVE ASSEMBLY FOR A PACKAGED TERMINAL AIR CONDITIONER UNIT

FIELD OF THE INVENTION

The present subject matter relates generally to packaged terminal air conditioner units, and more particularly to wall sleeve assemblies for packaged terminal air conditioner units.

BACKGROUND OF THE INVENTION

Refrigeration systems are generally utilized to adjust the temperature within a certain area. In the case of air conditioner units, one or more units may operate to adjust the temperature within structures such as dwellings and office buildings. In particular, one-unit type room air conditioner units may be utilized to adjust the temperature in, for example, a single room or group of rooms of a structure. Such air conditioner units may include, for instance, a sealed system to cool or heat the room. The sealed system may include a compressor, one or more heat exchangers, and an expansion device.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. More specifically, these units may be installed in a wall sleeve positioned within an opening of an exterior wall of a building.

PTACs often need to draw air from the outdoor portion into the indoor portion. Conventional PTACs include a vent aperture defined in the bulkhead that separates the indoor and outdoor side of the unit. To urge a flow of make-up air from the outdoor side of the PTAC into the conditioned room, an auxiliary fan and/or make-up air module may be fluidly coupled with the vent aperture. However, to provide a path for air to exit the room, PTACs often require a bathroom fan or another exhaust duct.

Accordingly, improved air conditioner units and fan assemblies for providing make-up air would be useful. More specifically, a wall sleeve assembly that provides for the intake and exhaust of air from a room would be particularly beneficial.

BRIEF DESCRIPTION OF THE INVENTION

Aspects and advantages of the invention will be set forth in part in the following description, may be obvious from the description, or may be learned through practice of the invention.

In accordance with one embodiment, a packaged terminal air conditioner unit for conditioning air in a room is provided. The package terminal air conditioner unit includes a bulkhead defining an indoor portion and an outdoor portion. A sealed system includes a compressor, an indoor heat exchanger positioned within the indoor portion, an outdoor heat exchanger positioned within the outdoor portion, and an expansion device, the sealed system being operable to transfer thermal energy between the indoor portion and the outdoor portion. A wall sleeve is configured for receiving at least a portion of the sealed system, the wall sleeve defining an intake aperture that fluidly couples the outdoor portion to the room. An intake fan assembly is mounted to the wall sleeve over the intake aperture for selectively urging a flow of make-up air into the room.

In accordance with another embodiment, a sleeve assembly for an air conditioner unit is provided. The sleeve assembly includes a wall sleeve that at least partially defines an outdoor portion and a room, the wall sleeve defining an intake aperture that fluidly couples the outdoor portion to the room. An intake fan assembly is mounted to the wall sleeve over the intake aperture for selectively urging a flow of make-up air into the room.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
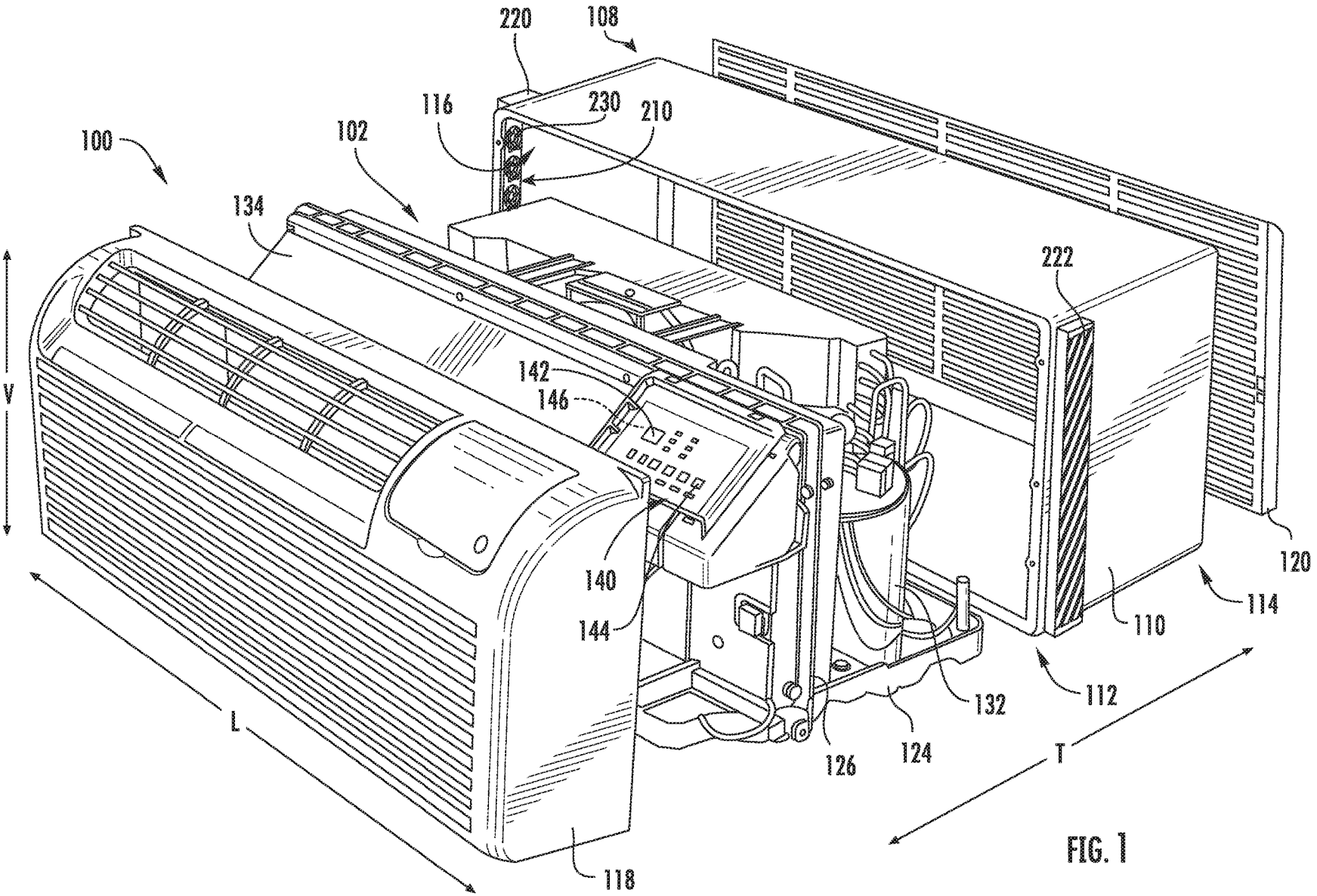
FIG. 1 provides an exploded perspective view of a packaged terminal air conditioner unit according to example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

FIG. 1 provides an exploded perspective view of a packaged terminal air conditioner unit 100 according to example embodiments of the present disclosure. Generally, packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 102 (i.e., sealed heat exchange system) of packaged terminal air conditioner unit 100 is disposed within a sleeve assembly 108. Thus, packaged terminal air conditioner unit 100 may be a self-contained or autonomous system for heating and/or cooling air. Packaged terminal air conditioner unit 100 defines a vertical direction V, a lateral direction L, and a transverse direction T that are mutually perpendicular and form an orthogonal direction system.

As used herein, the term "packaged terminal air conditioner unit" is applied broadly. For example, packaged terminal air conditioner unit 100 may include a supplementary electric heater (not shown) for assisting with heating air within the associated room or building without operating the sealed system 102. However, as discussed in greater detail below, packaged terminal air conditioner unit 100 may also include a heat pump heating mode that utilizes sealed system 102, e.g., in combination with an electric resistance heater, to heat air within the associated room or building. Indeed, aspects of the present subject matter may have applications involving sealed systems in any air conditioner unit or in other appliances using sealed systems, such as refrigeration appliances.

As may be seen in FIG. 1, sleeve assembly 108 includes a wall sleeve 110 extends between an interior side portion or indoor portion 112 and an exterior side portion or outdoor portion 114. Indoor portion 112 of wall sleeve 110 and outdoor portion 114 of wall sleeve 110 are spaced apart from each other. Thus, indoor portion 112 of wall sleeve 110 may be positioned at or contiguous with an interior atmosphere, and outdoor portion 114 of wall sleeve 110 may be positioned at or contiguous with an exterior atmosphere. Sealed system 102 includes components for transferring heat between the exterior atmosphere and the interior atmosphere, as discussed in greater detail below.

Wall sleeve 110 defines a mechanical compartment 116. Sealed system 102 is disposed or positioned within mechanical compartment 116 of wall sleeve 110. A front panel 118 and a rear grill or screen 120 hinder or limit access to mechanical compartment 116 of wall sleeve 110. Front panel 118 is positioned at or adjacent indoor portion 112 of wall sleeve 110, and rear screen 120 is mounted to wall sleeve 110 at outdoor portion 114 of wall sleeve 110. Front panel 118 and rear screen 120 each define a plurality of holes that permit air to flow through front panel 118 and rear screen 120, with the holes sized for preventing foreign objects from passing through front panel 118 and rear screen 120 into mechanical compartment 116 of wall sleeve 110.

Packaged terminal air conditioner unit 100 also includes a drain pan or bottom tray 124 and an inner wall or bulkhead 126 positioned within mechanical compartment 116 of wall sleeve 110. Sealed system 102 is positioned on bottom tray 124. Thus, liquid runoff from sealed system 102 may flow into and collect within bottom tray 124. Bulkhead 126 may be mounted to bottom tray 124 and extend upwardly from bottom tray 124 to a top wall of wall sleeve 110. Bulkhead 126 limits or prevents air flow between indoor portion 112 of wall sleeve 110 and outdoor portion 114 of wall sleeve 110 within mechanical compartment 116 of wall sleeve 110. Thus, bulkhead 126 may divide mechanical compartment 116 of wall sleeve 110. Specifically, bulkhead 126 may generally separate and define an indoor portion 112 and an outdoor portion 114.

Figure 2:
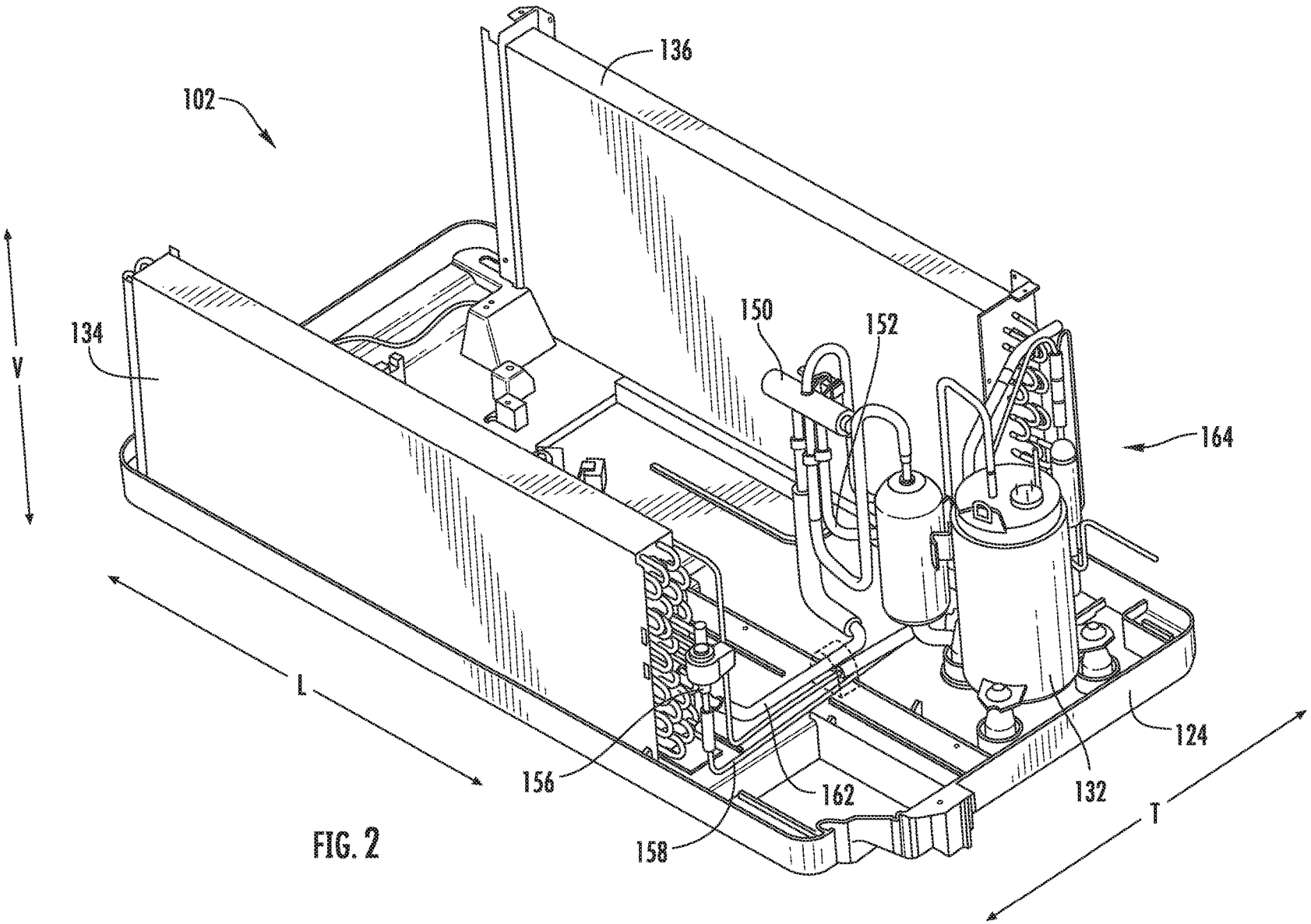
FIG. 2 provides a perspective view of a sealed system of the example packaged terminal air conditioner unit of FIG. 1.
Figure 3:
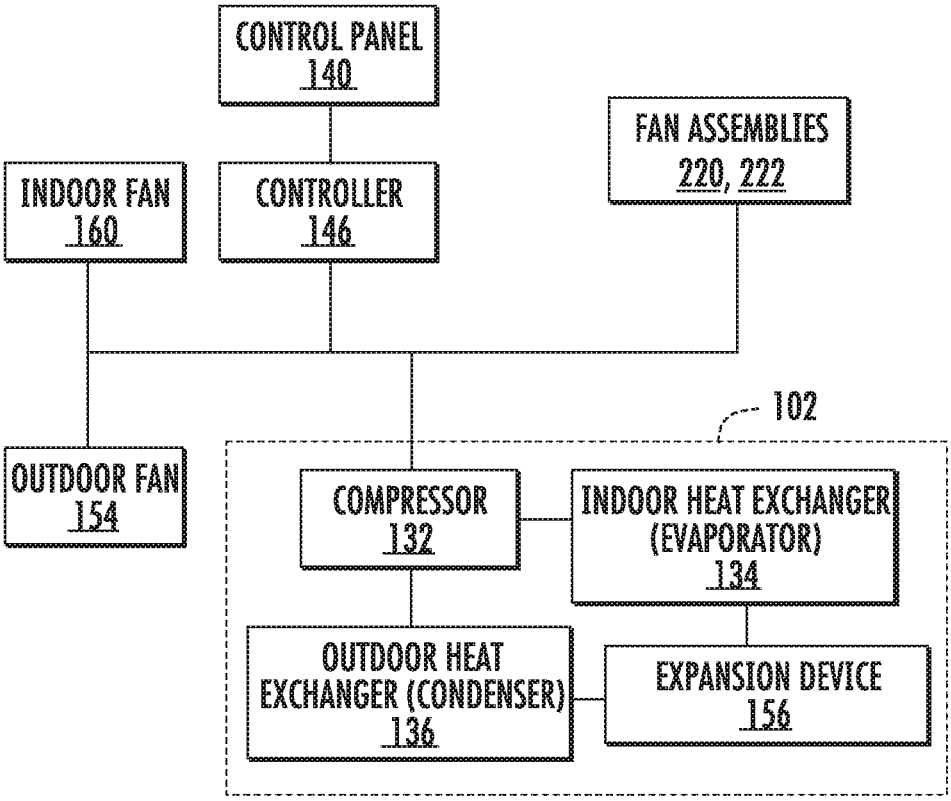
FIG. 3 provides a schematic view of a sealed system of the example packaged terminal air conditioner unit of FIG. 1.
Figure 4:
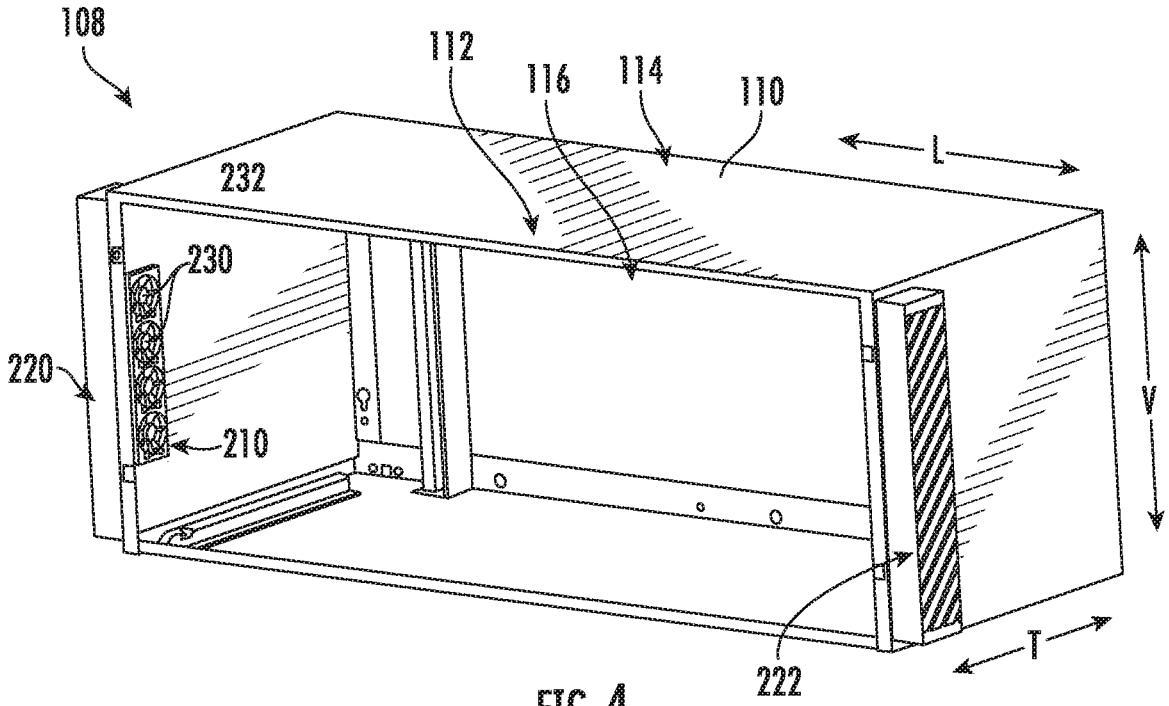
FIG. 4 provides a perspective view of a wall sleeve assembly for use with the exemplary packaged terminal air conditioner unit of FIG. 1 according to an exemplary embodiment of the present subject matter.

FIG. 2 provides a perspective view of certain components of packaged terminal air conditioner unit 100, including sealed system 102. In addition, FIG. 3 provides a schematic view of packaged terminal air conditioner unit 100. As shown, sealed system 102 includes a compressor 132, an interior heat exchanger or coil 134 and an exterior heat exchanger or coil 136. As is generally understood, compressor 132 is generally operable to circulate or urge a flow of refrigerant through sealed system 102, which may include various conduits which may be utilized to flow refrigerant between the various components of sealed system 102. Thus, interior coil 134 and exterior coil 136 may be between and in fluid communication with each other and compressor 132.

Referring again to FIG. 1, packaged terminal air conditioner unit 100 may additionally include a control panel 140 and one or more user inputs 142, which may be included in control panel 140. A display 144 may additionally be provided in the control panel 140, such as a touchscreen or other text-readable display screen. Alternatively, display 144 may simply be a light that can be activated and deactivated as required to provide an indication of, for example, an event or setting for the unit 100. The user inputs 142 and/or display 144 may be in communication with a controller 146. A user of packaged terminal air conditioner unit 100 may interact with the user inputs 142 to operate packaged terminal air conditioner unit 100, and user commands may be transmitted between the user inputs 142 and controller 146 to facilitate operation of packaged terminal air conditioner unit 100 based on such user commands.

Controller 146 may regulate operation of packaged terminal air conditioner unit 100, e.g., responsive to sensed conditions and user input from control panel 140. Thus, controller 146 is operably coupled to various components of packaged terminal air conditioner unit 100, such as control panel 140, components of sealed system 102, and/or a temperature sensor (not shown), such as a thermistor or thermocouple, for measuring the temperature of the interior atmosphere. In particular, controller 146 may selectively activate sealed system 102 in order to chill or heat air within sealed system 102, e.g., in response to temperature measurements from the temperature sensor.

In some embodiments, controller 146 includes memory and one or more processing devices. For instance, the processing devices may be microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

As will be described in further detail below, sealed system 102 may operate in a cooling mode and, alternately, a heating mode. During operation of sealed system 102 in the cooling mode, refrigerant generally flows from interior coil 134 and to compressor 132. During operation of sealed system 102 in the heating mode, refrigerant generally flows from exterior coil 136 and to compressor 132. As will be explained in more detail below, a compression reversing valve 150 in fluid communication with compressor 132 may control refrigerant flow to and from compressor 132, as well as the coils 134, 136.

During operation of sealed system 102 in the cooling mode, refrigerant flows from interior coil 134 and to compressor 132. For example, refrigerant may exit interior coil 134 as a fluid in the form of a superheated vapor. Upon exiting interior coil 134, the refrigerant may enter compressor 132, which is operable to compress the refrigerant. Accordingly, the pressure and temperature of the refrigerant may be increased in compressor 132 such that the refrigerant becomes a more superheated vapor.

Exterior coil 136 is disposed downstream of compressor 132 in the cooling mode and acts as a condenser. Thus, exterior coil 136 is operable to reject heat into the exterior atmosphere at outdoor portion 114 of wall sleeve 110 when sealed system 102 is operating in the cooling mode. For example, the superheated vapor from compressor 132 may enter exterior coil 136 via a first distribution conduit 152 (FIG. 2) that extends between and fluidly connects compression reversing valve 150 and exterior coil 136. Within exterior coil 136, the refrigerant from compressor 132 transfers energy to the exterior atmosphere and condenses into a saturated liquid and/or liquid vapor mixture. An exterior air handler or outdoor fan 154 (FIG. 3) is positioned adjacent exterior coil 136 and may facilitate or urge a flow of air from the exterior atmosphere across exterior coil 136 in order to facilitate heat transfer.

According to the illustrated embodiment, an expansion device or a variable electronic expansion valve 156 may be further provided to regulate refrigerant expansion. Specifically, variable electronic expansion valve 156 is disposed along a fluid conduit 158 that extends between interior coil 134 and exterior coil 136. During use, variable electronic expansion valve 156 may generally expand the refrigerant, lowering the pressure and temperature thereof. In the cooling mode, refrigerant, which may be in the form of high liquid quality/saturated liquid vapor mixture, may exit exterior coil 136 and travel through variable electronic expansion valve 156 before flowing through interior coil 134. In the heating mode, refrigerant, may exit interior coil 134 and travel through variable electronic expansion valve 156 before flowing to exterior coil 136. As described in more detail below, variable electronic expansion valve 156 is generally configured to be adjustable. In other words, the flow (e.g., volumetric flow rate in milliliters per second) of refrigerant through variable electronic expansion valve 156 may be selectively varied or adjusted.

Interior coil 134 is disposed downstream of variable electronic expansion valve 156 in the cooling mode and acts as an evaporator. Thus, interior coil 134 is operable to heat refrigerant within interior coil 134 with energy from the interior atmosphere at indoor portion 112 of wall sleeve 110 when sealed system 102 is operating in the cooling mode. For example, the liquid or liquid vapor mixture refrigerant from variable electronic expansion valve 156 may enter interior coil 134 via fluid conduit 158. Within interior coil 134, the refrigerant from variable electronic expansion valve 156 receives energy from the interior atmosphere and vaporizes into superheated vapor and/or high quality vapor mixture. An interior air handler or indoor fan 160 (FIG. 3) is positioned adjacent interior coil 134 and may facilitate or urge a flow of air from the interior atmosphere across interior coil 134 in order to facilitate heat transfer. From interior coil 134, refrigerant may return to compressor 132 from compression reversing valve 150, e.g., via a second conduit 162 (FIG. 2) that extends between and fluidly connects interior coil 134 and compression reversing valve 150.

During operation of sealed system 102 in the heating mode, compression reversing valve 150 reverses the direction of refrigerant flow from compressor 132. Thus, in the heating mode, interior coil 134 is disposed downstream of compressor 132 and acts as a condenser, e.g., such that interior coil 134 is operable to reject heat into the interior atmosphere at indoor portion 112 of wall sleeve 110. In addition, exterior coil 136 is disposed downstream of variable electronic expansion valve 156 in the heating mode and acts as an evaporator, e.g., such that exterior coil 136 is operable to heat refrigerant within exterior coil 136 with energy from the exterior atmosphere at outdoor portion 114 of wall sleeve 110.

Referring specifically to FIG. 2, sealed system 102 may further include a line filter assembly 164 which is generally configured for removing or collecting contaminants from the flow of refrigerant, such as byproducts from brazing or other manufacturing processes, that may have accumulated within sealed system 102 (e.g., during assembly) and might otherwise damage moving elements (e.g., compressor 132) or restrict small orifices (e.g., at expansion device 156). As illustrated, line filter assembly 164 is positioned between and fluidly couples indoor heat exchanger 134 and outdoor heat exchanger 136. Line filter assembly 164 may include a filter media for collecting contaminants, a desiccant material, such as a zeolite molecular sieve, to remove undesired moisture that may be present in sealed system 102, etc. However, it should be appreciated that according to alternative embodiments, line filter assembly 164 may have any other suitable configuration and may be positioned at any other suitable location within sealed system 102.

Referring now generally to FIGS. 4 through 7, sleeve assembly 108 will be described in more detail according to an exemplary embodiment of the present subject matter. In general, during installation of packaged terminal air conditioner unit 100, sleeve assembly 108 is first mounted within an opening 170 defined within a building wall 172 (see FIG. 7). For example, in an exemplary application, sleeve assembly 108 is mounted to building wall 172 using any suitable mechanical fastener, welding, adhesive, etc. In addition, the joint between wall sleeve 110 and building wall 172 may be sealed using any suitable caulk, sealant, etc. Bulkhead 126, sealed system 102, and other components of packaged terminal air conditioner unit 100 are then mounted at least partially within wall sleeve 110.

Wall sleeve 110 may generally have any suitable construction. For example, according to the illustrated embodiment, wall sleeve 110 is constructed from steel and is formed as a rectangular box. According to alternative embodiments, all or a portion of the walls of wall sleeve 110 may have a multi-layer noise damping construction, e.g., for damping noise generated by sealed system 102, or otherwise reducing vibrations or excessive noise within the room which may transmit easily through conventional single ply wall sleeves. According to still other embodiments, wall sleeve 110 may include any suitable number of layers, materials, interweaving of layers, or other configurations.

As explained above, and as best shown in FIG. 7, packaged terminal air conditioner unit 100 may be positioned in an opening 170 of a building wall 172. In addition, wall sleeve 110 and bulkhead 126 may generally define indoor portion 112 and outdoor portion 114 of packaged terminal air conditioner unit 100. Notably, when unit 100 is installed, indoor portion 112 may generally be in fluid communication with an interior of room, referred to herein simply as room 200. By contrast, outdoor portion 114 may generally be in fluid communication with the ambient environment 202, e.g., on the opposite side of building wall 172 from room 200. In this manner, when unit 100 is properly installed, two substantially isolated environments are defined, while sealed system 102 may be operated to transfer thermal energy between the two environment, e.g., by circulating refrigerant using compressor 132.

Notably, as mentioned above, under certain conditions, it may be desirable to selectively supply a flow of makeup air (e.g., as identified herein by reference numeral 204) into room 200 from environment 202. In addition, it may sometimes be desirable to direct a flow of exhaust air (e.g., as identified herein by reference numeral 206) out of room 200 and into the environment 202. Sleeve assembly 108 as described herein defines or includes features for facilitating such air transfer between room 200 and environment 202. Although such features will be described below according to exemplary embodiments, it should be appreciated that variations and modifications may be made while remaining within the scope of the present subject matter.

Referring generally to FIGS. 4 through 7, wall sleeve 110 generally defines an intake aperture 210 that fluidly couples outdoor portion 114 with room 200. In addition, wall sleeve 110 may define an exhaust aperture 212 that also fluidly couples outdoor portion 114 with room 200. Specifically, according to the illustrated embodiment, intake aperture 210 and exhaust aperture 212 are defined on opposite sides of wall sleeve 110 along the lateral direction L. In this manner, the flow of makeup air 204 may pass into room 200 from one side, while the flow of exhaust air 206 passes out of room 200 from the opposite side, thereby minimizing interaction between the flows of air.

In addition, wall sleeve assembly 108 generally includes an intake fan assembly 220 that is mounted to wall sleeve 110 over intake aperture 210 for selectively urging the flow of makeup air 204 into room 200. Similarly, sleeve assembly 108 includes an exhaust fan assembly 222 mounted to the wall sleeve 100 over exhaust aperture 212 for selectively urging the flow of exhaust air 206 out of room 200.

Although sleeve assembly 108 is illustrated herein as including a dedicated intake fan assembly 220 and exhaust fan assembly 222, it should be appreciated that according to alternative embodiments only a single fan assembly may be used. For example, according to alternative embodiments, unit 100 may require only intaking or exhausting air and thus may need only a single fan assembly. According to still other embodiments, a single fan assembly may operate in a bidirectional manner for both drawing in makeup air and exhausting exhaust air through the same aperture. Sleeve assembly 108 may further include airflow plumbing or routing the ducts which facilitate bidirectional operation of a single fan assembly. Thus, it should be appreciated that sleeve assembly 108 is described herein only as an example embodiment and is not intended to limit the scope of the present subject matter. Other fan assemblies and flow regulating devices may be used and may include a different number of fans, positions, configurations, etc.

As illustrated, intake aperture 210 and exhaust aperture 212 extend through a sidewall of wall sleeve 110 such that they are positioned between building wall 172 and bulkhead 126 along the transverse direction T when unit 100 is installed. In this manner, these apertures may provide direct fluid communication between outdoor portion 114 and room 200. In addition, intake fan assembly 220 and exhaust fan assembly 222 are illustrated as low-profile assemblies which may be positioned within wall sleeve 110 without having to reconfigure components of unit 100 (e.g., such as sealed system 102 components within mechanical compartment 116). In addition, the low-profile construction of fan assemblies 220, 222 do not protrude far into room 200.

Intake fan assembly 220 will now be described in detail according to an exemplary embodiment of the present subject matter. Due to the similarity between intake fan assembly 220 and exhaust fan assembly 222, exhaust fan assembly 222 will not be explicitly described. However, it should be appreciated that exhaust fan assembly 222 may be similar in some or all respects with intake fan assembly 220, and like features will be similarly labeled in the figures.

Figure 5:
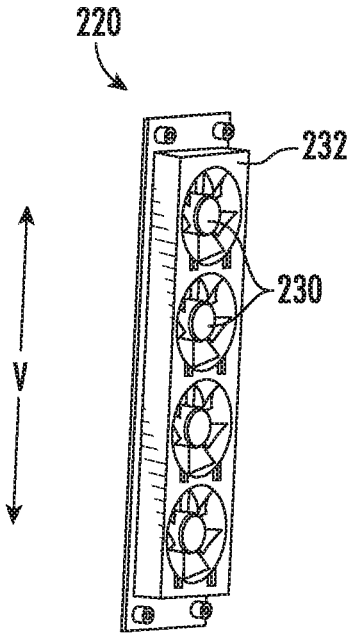
FIG. 5 provides a perspective view of a fan assembly that may be part of the exemplary wall sleeve assembly of FIG. 4 according to an exemplary embodiment of the present subject matter.
Figure 6:
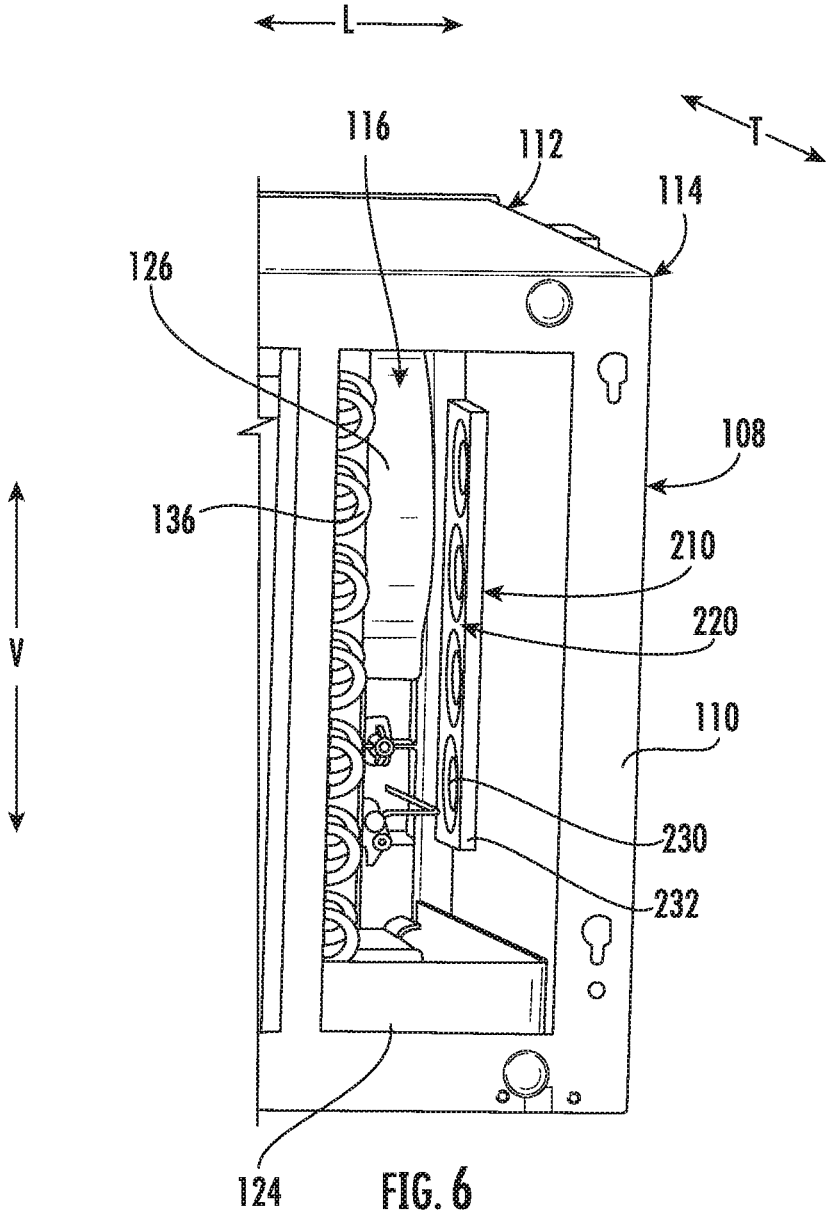
FIG. 6 provides a rear perspective view of the exemplary packaged terminal air conditioner unit of FIG. 1.

As best shown in FIG. 5, intake fan assembly 220 generally includes a plurality of fans 230 stacked adjacent each other along a vertical direction V. Specifically, according to the illustrated embodiment, fans 230 are small axial fans, sometimes referred to as muffin fans. However, it should be appreciated that according to alternative embodiments, any other suitable air moving device, such as a centrifugal fan or a tangential fan may be used while remaining within the scope of the present subject matter. In addition, fans 230 mounted within a single housing 232 which is sized to fit snugly within intake aperture 210. However, any other suitable number and type of fans mounted in any other suitable manner may be used.

In addition, according to an exemplary embodiment, fans 230 are configured for operating off a 24 volt direct-current power supply, which may be supplied directly from controller 146 of packaged terminal air conditioner unit 100. Specifically, as shown for example in FIG. 7, controller 146 is directly communicatively and electrically coupled to fans 230. In this manner, controller 146 may regulate operation of fans 230 according to the desired air conditioning needs and using an internal power supply, such that an external power supply for fans 230 is not required. It should be appreciated that alternative power supply sources and voltages may be used according to alternative embodiments.

Moreover, fans 230, or more particularly intake fan assembly 220, may have any suitable rated flow rate as needed for the particular makeup air and exhaust air needs of a unit 100. For example, according to an exemplary embodiment, the rated flow rate of intake fan assembly 220 may be greater than 30 cubic feet per minute (CFM). According still other embodiments, the rated air flow rate may be greater than 40 CFM, 50 CFM, or higher. According to still other embodiments, the rated flow rate may be less than 100 CFM, less than 70 CFM, less than 30 CFM, or lower.

Notably, because intake fan assembly 220 and exhaust fan assembly 222 are configured for providing direct fluid communication between ambient environment 202 and room 200, it may be desirable to include one or more filters or screens to prevent dust, debris, particulates, bugs, or other contaminants from entering into room 200. Specifically, as best illustrated schematically in FIGS. 7 and 8, intake fan assembly 200 may include an air filter 240, e.g., for filtering the flow of makeup air 204. In addition, or alternatively, a bug screen (e.g., such as a fine mesh filter) may be mounted to intake fan assembly 220. According to the illustrated embodiment, air filter 240 is positioned upstream of fans 230, though other positions are possible and within the scope of the present subject matter.

Figure 7:
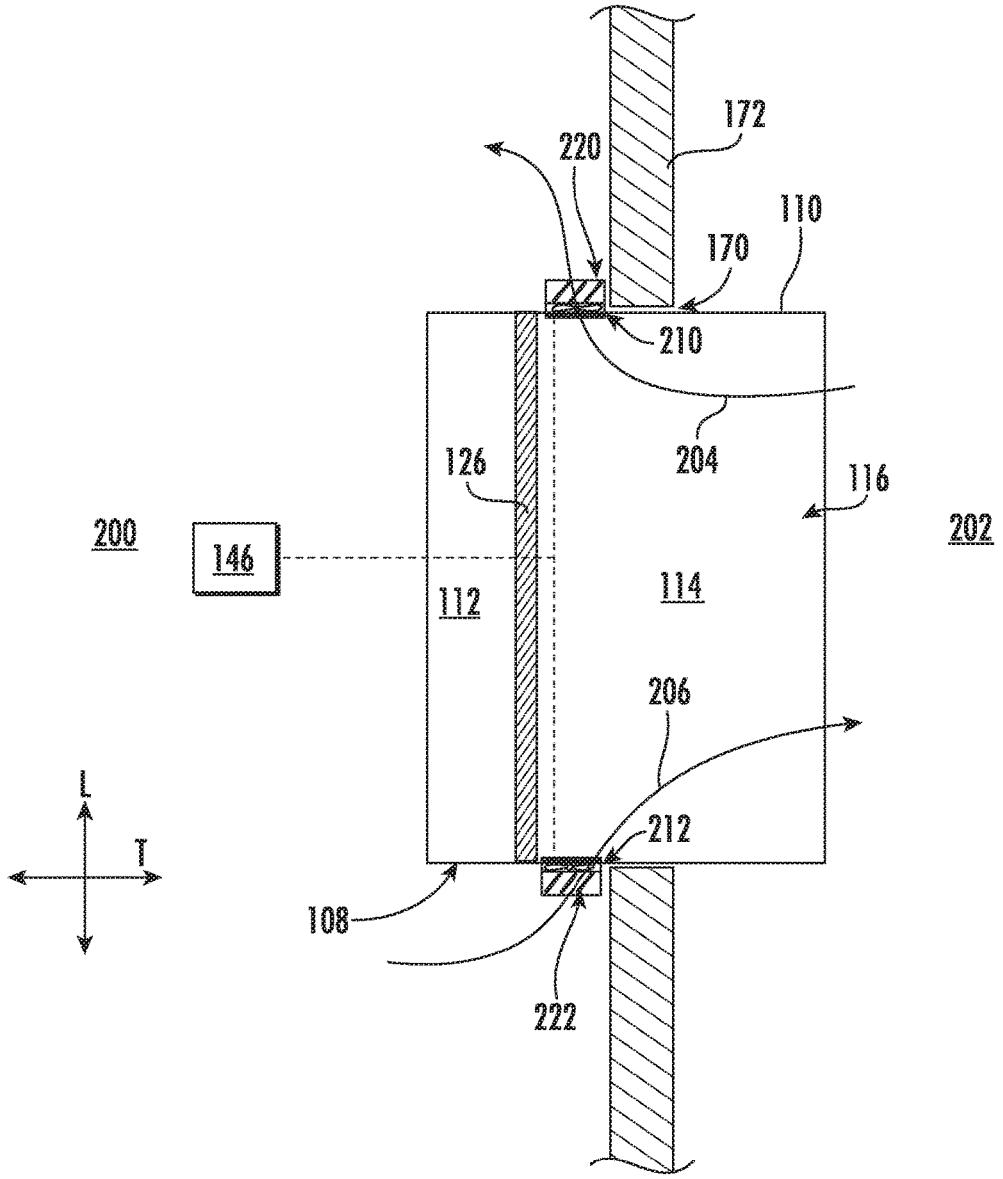
FIG. 7 provides a schematic view of the exemplary wall sleeve assembly of FIG. 4 installed in an exterior wall of a room according to an exemplary embodiment.
Figure 8:
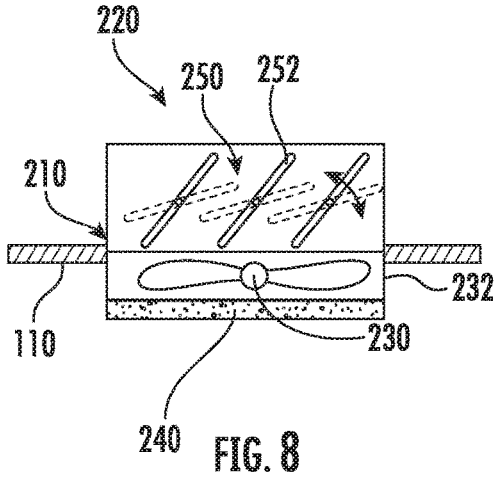
FIG. 8 provides a close up, schematic view of the exemplary fan assembly of FIG. 5 according to an exemplary embodiment.

Referring still to FIGS. 7 and 8, sleeve assembly 108 may further include features for preventing the flow of air through either intake aperture 210 or exhaust aperture 212 when such flow is not desirable. In this regard, for example, when the flow of makeup air 204 is not needed, fans 230 may be turned off, but air may still travel through the stationary fans 230 into or out of room 200. Thus, as illustrated, intake fan assembly 220 (and also exhaust assembly 222) may include a flow regulating device 250. Although an exemplary flow regulating device 250 is described below, it should be appreciated that any other suitable manner of regulating the flow of makeup air 204, the flow of exhaust air 206, or to otherwise open or close apertures 210, 212 may be used.

As illustrated, flow regulating device 250 includes one or more louvers 252 that are rotatably mounted within fan housing 232 to pivot between a fully open position, where the flow of makeup air 204 is substantially unrestricted, and a fully closed position, where the flow of makeup air 204 is a substantially blocked. In addition, it should be appreciated that louvers 252 may be moved to any suitable position between the fully open and fully closed positions to help regulate the flow of makeup air 204 or the flow of exhaust air 206, e.g., in conjunction with regulating the rotational speed of fans 230. It should be appreciated that controller 146 may be used to regulate the operation of fan assemblies 220, 222 such as regulating the speeds of fans 230, the position of louvers 252, etc.

Notably, it may be desirable to heat, cool, dehumidify, or otherwise condition the flow of makeup air 204 that passes into room 200. For example, if it is hot outside, it may be desirable to cool the flow of makeup air 204. Thus, according to an exemplary embodiment, sealed system may operate in an AC mode to cool and/or dehumidify the flow of makeup air 204 by continually circulating air from within room 200. Similarly, if it is cool outside, it may be desirable to heat the flow of makeup air 204. Thus, according to an exemplary embodiment, sealed system may operate in a heat pump mode to heat the flow of makeup air 204 within room 200.

According to still another embodiment, sealed system 102 may include a reheat heat exchanger to facilitate dehumidification of the flow of makeup air 204 without providing an excessively cool flow of makeup air 204 into the room 200. This may be desirable, for example, if it is relatively cool but humid outside. It should be appreciated that such a reheat heat exchanger is typically positioned downstream of a primary indoor heat exchanger relative to a flow of indoor air. In this manner, the flow of air is cooled through the primary indoor heat exchanger (e.g., to dehumidify the air by lowering its temperature and producing condensate). However, instead of passing the cooled, dehumidified air directly back into the room, it is next passed through the reheat heat exchanger. The reheat heat exchanger, for example, may be connected to the primary indoor heat exchanger through an expansion device, which may be throttled to pass hot refrigerant through its coils to reheat the overcooled air.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit for conditioning air in a room, the package terminal air conditioner unit comprising:

a wall sleeve defining a mechanical compartment and an intake aperture;

a bulkhead mounted within the wall sleeve to divide the mechanical compartment into an indoor portion and an outdoor portion;

a sealed system comprising a compressor, an indoor heat exchanger positioned within the indoor portion, an outdoor heat exchanger positioned within the outdoor portion, and an expansion device, the sealed system being operable to transfer thermal energy between the indoor portion and the outdoor portion;

and an intake fan assembly mounted to the wall sleeve over the intake aperture for selectively urging a flow of make-up air into the room.

2. The packaged terminal air conditioner unit of claim 1, wherein the wall sleeve further defines an exhaust aperture that fluidly couples the outdoor portion to the room, the packaged terminal air conditioner unit further comprising:

an exhaust fan assembly mounted to the wall sleeve over the exhaust aperture for selectively urging a flow of exhaust air out of the room.

3. The packaged terminal air conditioner unit of claim 2, wherein the intake aperture and the exhaust aperture are defined on opposite sides of the wall sleeve along a lateral direction.

4. The packaged terminal air conditioner unit of claim 1, wherein the wall sleeve is mountable within an opening in a building wall.

5. The packaged terminal air conditioner unit of claim 1, wherein the intake fan assembly comprises a plurality of muffin fans stacked adjacent each other in a fan housing.

6. The packaged terminal air conditioner unit of claim 1, wherein the intake fan assembly operates off 24 volts DC.

7. The packaged terminal air conditioner unit of claim 1, wherein the intake fan assembly is rated for a flow rate of greater than 40 cubic feet per minute.

8. The packaged terminal air conditioner unit of claim 1, wherein the intake fan assembly further comprises:

at least one of an air filter or a bug screen.

9. The packaged terminal air conditioner unit of claim 1, further comprising:

a flow regulating device for preventing air from passing through the intake fan assembly into the room when the intake fan assembly is off.

10. The packaged terminal air conditioner unit of claim 9, wherein the flow regulating device comprises:

one or more louvres for selectively opening or closing to regulate the flow of make-up air.

11. A sleeve assembly for an air conditioner unit, the sleeve assembly comprising:

a wall sleeve that defines a mechanical compartment for receiving a bulkhead to divide the mechanical compartment into an outdoor portion and a room, the wall sleeve defining an intake aperture that fluidly couples the outdoor portion to the room; and an intake fan assembly mounted to the wall sleeve over the intake aperture for selectively urging a flow of make-up air into the room.

12. The sleeve assembly of claim 11, wherein the wall sleeve further defines an exhaust aperture that fluidly couples the outdoor portion to the room, the sleeve assembly further comprising:

an exhaust fan assembly mounted to the wall sleeve over the exhaust aperture for selectively urging a flow of exhaust air out of the room.

13. The sleeve assembly of claim 12, wherein the intake aperture and the exhaust aperture are defined on opposite sides of the wall sleeve along a lateral direction.

14. The sleeve assembly of claim 11, wherein the wall sleeve is mountable within an opening in a building wall.

15. The sleeve assembly of claim 11, wherein the intake fan assembly comprises a plurality of muffin fans stacked adjacent each other in a fan housing.

16. The sleeve assembly of claim 11, wherein the intake fan assembly operates off 24 volts DC.

17. The sleeve assembly of claim 11, wherein the intake fan assembly is rated for a flow rate of greater than 40 cubic feet per minute.

18. The sleeve assembly of claim 11, wherein the intake fan assembly further comprises:

at least one of an air filter or a bug screen.

19. The sleeve assembly of claim 11, further comprising:

a flow regulating device for preventing air from passing through the intake fan assembly into the room when the intake fan assembly is off.

20. The sleeve assembly of claim 19, wherein the flow regulating device comprises:

one or more louvres for selectively opening or closing to regulate the flow of make-up air.

* * * * *